United States Patent [19]

Roberts

[11] Patent Number: 4,765,849

[45] Date of Patent: Aug. 23, 1988

[54] LOW-ALLOY STEEL MATERIAL, DIE BLOCKS AND OTHER HEAVY FORGINGS MADE THEREOF

[75] Inventor: William Roberts, Hagfors, Sweden

[73] Assignee: Uddeholm Tooling Aktiebolag, Hagfors, Sweden

[21] Appl. No.: 29,158

[22] Filed: Mar. 23, 1987

Related U.S. Application Data

[62] Division of Ser. No. 867,566, May 28, 1986, Pat. No. 4,673,433.

[51] Int. Cl.[4] ..... C22C 38/50

[52] U.S. Cl. ..... 148/335; 420/109

[58] Field of Search ..... 148/335; 420/109

[56] References Cited

U.S. PATENT DOCUMENTS

| | | | |
|---|---|---|---|
| 4,318,739 | 3/1982 | Lehman | 420/109 |
| 4,457,789 | 7/1984 | Wilks | 148/335 |
| 4,673,433 | 6/1987 | Roberts | 420/109 |

FOREIGN PATENT DOCUMENTS

| | | | |
|---|---|---|---|
| 0112220 | 9/1978 | Japan | 420/109 |
| 0037156 | 3/1983 | Japan | 148/335 |
| 0230965 | 11/1985 | Japan | 148/335 |
| 0298685 | 3/1971 | U.S.S.R. | 420/109 |
| 0727706 | 4/1980 | U.S.S.R. | 148/335 |
| 0931791 | 5/1982 | U.S.S.R. | 420/109 |

*Primary Examiner*—Melvyn J. Andrews
*Assistant Examiner*—David W. Schumaker
*Attorney, Agent, or Firm*—Murray and Whisenhunt

[57] ABSTRACT

A method for manufacturing a low-alloy steel product having a very high hardenability in relation to its alloying content is disclosed. The method includes the steps of melting the steel; adding thereto a micro-alloying ingredient selected from group consisting of aluminum, titanium, and aluminum and titanium together; superheating the melt to a temperature of at least 1625° C., holding the melt at the temperature level for at least two minutes; teeming and casting the melt to form ingots and hot-working the ingots to form a low alloy steel product of the following composition:

| Element | Wt % |
|---|---|
| C | 0.3–0.55 |
| Mn | 0.3–1.5 |
| Si | trace–1.0 |
| Cr | .75–1.8 |
| Ni | trace–2.0 |
| Mo | 0.05–0.4 |
| V | 0.05–0.15 |
| P | 0.03 Max |
| S | trace–0.05 |
| Al | 0.04–0.1 or |
| Ti | 0.015–0.08 or |
| Al + Ti | 0.04–0.16 |

5 Claims, 3 Drawing Sheets

JOMINY TESTING AFTER 875°C / 30MIN
STEEL OF THE PRESENT INVENTION (TABLE 6)
EXPECTED CURVE FOR STEEL WITH SAME BASE ANALYSIS AS IN TABLE 6
HRC
70
60
50
40
30
0
20
40
60
80
100
DISTANCE FROM QUENCHED END, [MM]

CONVENTIONAL, COMPARISON DIE BLOCK
(STEEL IN TABLE 7)

DIE BLOCK OF PRESENT INVENTION
(STEEL IN TABLE 6)
[AUSTENITIZE 843°C/10h, OIL QUENCH TO 121°C, TEMPER 604°C/12h]

FIGURES GIVEN INDICATE BRINELL HARDNESS NUMBER

LOW-ALLOY STEEL MATERIAL, DIE BLOCKS AND OTHER HEAVY FORGINGS MADE THEREOF

This is a divisional application of Ser. No. 867,566, filed May 28, 1986, now U.S. Pat. No. 4,673,433.

TECHNICAL FIELD

This invention relates to low-alloy steel material and heavy-section forgings made thereof and in particular to low-alloy steel forging die blocks and associated parts. The invention is also concerned with a method to manufacture the low-alloy steel and in particular to a special procedure which imparts very high hardenability in relation to the alloying level. This means that the alloying costs for the die block are considerably lower than for present commercially-used products without there arising any adverse effects as regards die block performance. The above-mentioned "associated parts" includes inserts, guide pins, tie plates, ram guides and rams for drop hammers and bolster plates for presses, all of which will hereafter be referred to collectively as die blocks.

BACKGROUND TO THE INVENTION

Forging die blocks operate under severe mechanical and thermal conditions. They are subjected to intermittent heating and cooling, high stresses and severe abrasion. The important properties for a steel to be used in forging die blocks are:

1: Good hardenability, since it is normal for a cavity to be resunk several times during the life of a block;
2: Good machinability; the blocks are pre-hardened and have to be machined extensively during their lifetime;
3: Adequate degree of toughness particularly in the center of the block;
4: Retention of strength and wear resistance at high temperatures.

The properties described in points 1–3 above are in fact desirable characteristics for all heavy forgings.

SUMMARY OF THE INVENTION

The present invention revolves primarily around point 1 above, hardenability. However, the composition of the steel and method of manufacture are such that points 2–4 are also adequately fulfilled in the finished die block. The hardenability of a steel describes its propensity to form non-martensitic transformation products, such as bainite or pearlite, during cooling from the austenitic condition. The higher the hardenability, the more slowly the steel can be cooled while retaining a fully-hardened (martensitic) microstructure. To increase the hardenability of steel, it is normally necessary to raise the level of alloying, since most alloying elements retard transformations during cooling. However, increasing the alloying level naturally increases the production cost of the steel.

The primary object of the present invention is to provide a steel material for forging die blocks and other heavy forgings with extremely good hardenability which, at the same time, is more economical to produce than existing grades.

One aspect of the invention is also to provide a method of making steel more hardenable by a special melting practice. In this, a hardenable steel melt is produced and then superheated prior to teeming such that the entire melt attains a temperature of not less than 1625° C. The melt is then held at not less than 1625° C. for at least two minutes prior to vacuum treatment (optional) and teeming.

According to another aspect of the invention, the steel melt prior to performing the above-mentioned superheating should be microalloyed with aluminium, in excess of that required to kill the steel, or with titanium, or-with both aluminium and titanium. The amount of aluminium when added alone should be sufficient to achieve a final melt content in weight percent of between 0.4% and 0.1%; if titanium is used alone, the final melt content of titanium should be between 0.015% and 0.08%; and if both aluminum and titanium are added, the total content in weight percent of aluminum plus two times the amount of titanium should be between about 0.04% and about 0.16%.

The broad compositional range for the steel which is to be treated in the above way is (weight percent):

TABLE 1

| | |
|---|---|
| Carbon | 0.3 to 0.55 |
| Manganese | 0.3 to 1.5 |
| Silicon | from traces up to 1.0 |
| Chromium | 0.75 to 1.8 |
| Nickel | from traces up to 2.0 |
| Molybdenum | 0.05 to 0.4 |
| Vanadium | 0.05 to 0.15 |
| Phosphorous | 0.03 max |
| Sulphur | from traces up to 0.05 |
| Aluminum | 0.04 to 0.1 or |
| Titanium | 0.015 to 0.08, or |
| Aluminum and Titanium, wherein the total amount of Al + 2 × Ti is | about 0.04 to about 0.16, |

balance essentially only iron and normal impurities and incidental ingredients, particularly impurities and incidental ingredients associated with, above all, scrap-based steel making.

However, for application as forging die blocks, the following composition range is to be preferred (weight percent):

TABLE 2

| | |
|---|---|
| Carbon | 0.4 to 0.55 |
| Manganese | 0.5 to 1.2 |
| Silicon | from traces up to 1.0 |
| Chromium | 1.1 to 1.8 |
| Nickel | 0.2 to 1.2 |
| Molybdenum | 0.15 to 0.4 |
| Vanadium | 0.05 to 0.15 |
| Phosphorus | 0.025 max |
| Sulphur | 0.005 to 0.05 |
| Aluminum | 0.04 to 0.08 or |
| Titanium | 0.015 to 0.06 or |
| Aluminum and Titanium, wherein the total amount of Al + 2 × Ti is | about 0.04 to about 0.13, |

balance essentially only iron and normal impurities and incidental ingredients, particularly impurities and incidental ingredients associated with, above all, scrap-based steel making.

For the compositional range as in Table 2, the following, narrower composition ranges may be chosen: manganese 0.6 to 1.1, silicon up to 0.5, and sulphur 0.02 to 0.05.

The most preferred compositional range for forging die blocks is as follows (weight percent):

TABLE 3

| | |
|---|---|
| Carbon | 0.42 to 0.49 |
| Manganese | 0.6 to 1.0 |
| Silicon | up to 0.4 |
| Chromium | 1.4 to 1.7 |

TABLE 3-continued

| | |
|---|---|
| Nickel | 0.2 to 0.8 |
| Molybdenum | 0.15 to 0.30 |
| Vanadium | 0.07 to 0.13 |
| Phosphorous | 0.025 max |
| Sulphur | 0.025 to 0.045 |
| Aluminum | 0.04 to 0.07 or |
| Titanium | 0.015 to 0.06 or |
| Aluminum and Titanium, wherein the total amount of Al + 2 × Ti is | about 0.04 to about 0.12, |

balance essentially only iron and normal impurities and incidental ingredients, particularly impurities and incidental ingredients associated with, above all, scrap-based steel making.

Once a steel within the most preferred compositional range has been melted, subjected to the special treatment outlined above and then teemed to produce ingots, it can be shaped to forging die blocks via normal forging procedures. Similarly the heat treatment (quenching and tempering) of the die block, whereby the required level of hardness is attained, can be performed by conventional methods.

This heat treatment includes austenitization of the steel block or corresponding piece of steel at a temperature between 800° C. and 900° C. for a period of time of 2 to 20 hours, thereafter quenching in oil or water and eventually tempering at a temperature between 500° C. and 700° C., preferably between 550° C. and 650° C., suitably at about 600° C. for about 2 to 20 hours.

BRIEF DESCRIPTION OF DRAWINGS

In the following description of tests performed, reference will be made to the drawings, in which FIG. 1 compares Jominy hardenability curves (hardness versus distance from the quenched end of the Jominy specimen) for four laboratory-melted steels.

DESCRIPTION OF TESTS PERFORMED AND DETAILS OF RESULTS

The details of the present invention have been established partly via laboratory experimentation (2 kg ingots) and partly through manufacture of a full-scale charge of steel (30 tons).

The compositions of the laboratory ingots which have been studied are presented in Table 4 below.

TABLE 4

| | Chemical composition (weight %) of the laboratory ingots investigated. | | | | | | | |
|---|---|---|---|---|---|---|---|---|
| Steel No. | C | Mn | Si | Cr | Mo | Ni | V | Ti |
| A | 0.41 | 0.71 | 0.32 | 1.03 | 0.37 | 0.44 | 0.07 | — |
| B | 0.41 | 0.59 | 0.20 | 1.10 | 0.37 | 0.44 | 0.11 | 0.030 |
| C | 0.39 | 0.65 | 0.34 | 1.11 | 0.35 | 0.41 | 0.08 | 0.038 |
| D | 0.42 | 0.87 | 0.30 | 1.49 | 0.20 | 0.42 | 0.08 | 0.032 |

Steels A, C and D were during manufacture superheated to 1650° C. under two minutes prior to teeming. For steel B, on the other hand, a normal melting practice involving heating to a maximum temperature of 1570° C. was adopted.

The small laboratory ingots were hot forged in a 350 ton press to 30 mm square section and standard Jominy specimens were machined from these bars. Jominy testing was performed after austenization at 875° C./30 minutes.

Figure 1:
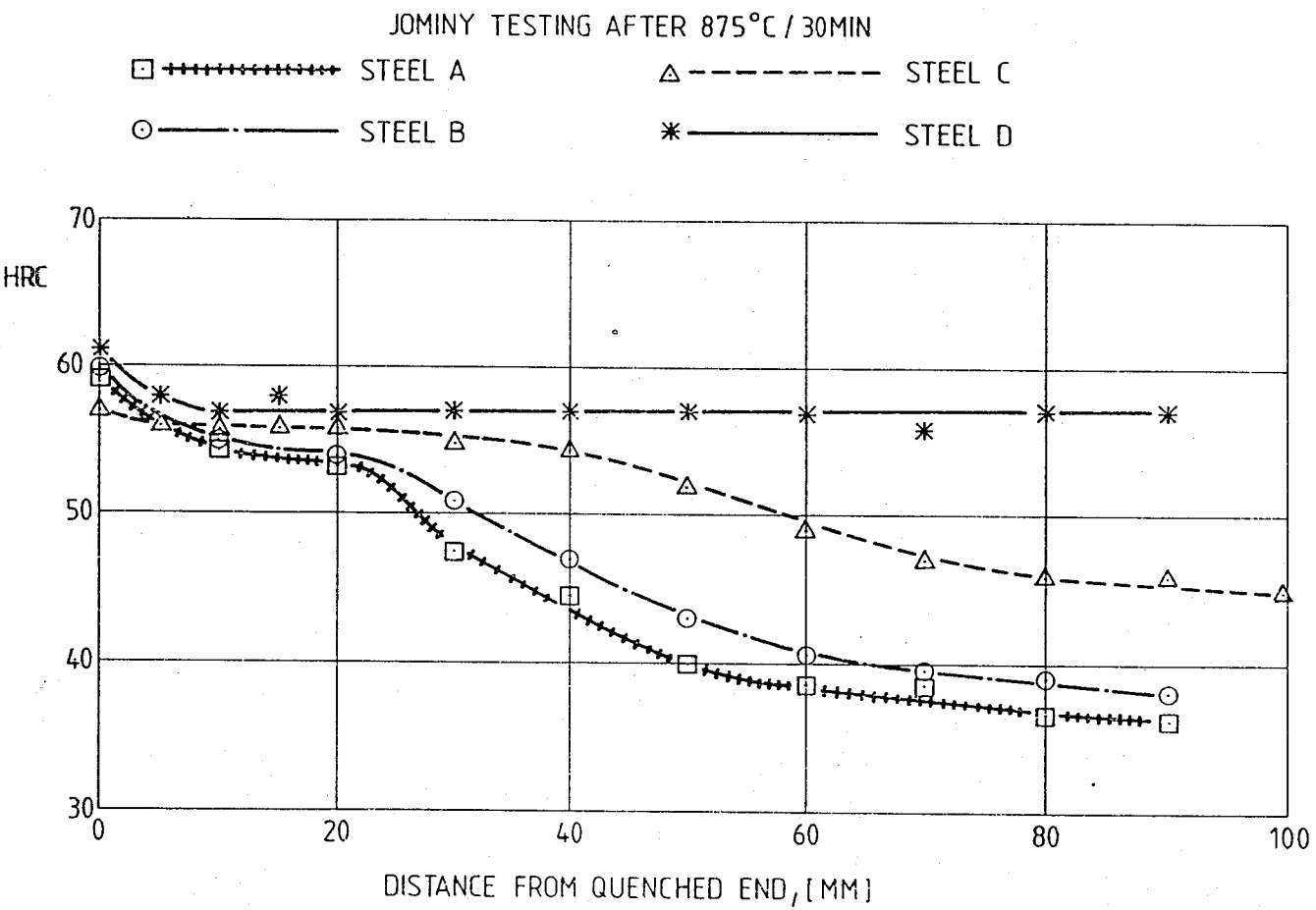

In FIG. 1, Jominy hardenability curves are shown for the four steels A–D. In these, the Rockwell hardness is plotted as a function of the distance from the end of the specimen which is quenched during the Jominy-test procedure. A rapid drop-off in hardness with increasing distance from the quenched end is indicative of low hardenability; in other words, the closer the Jominy curve is to a horizontal line, the greater is the hardenability. Steels A–C have similar base analyses with regard to carbon, manganese, chromium, molybdenum, nickel and vanadium; however, their Jominy hardenability curves are very different (FIG. 1). Steel C, which is characterized by:

(a) a titanium microaddition; and (b) superheating to 1650° C. under two minutes prior to teeming, exhibits significantly greater hardenability than Steels A or B.

Steel A was subjected to superheating to 1650° C. under two minutes prior to teeming, but does not contain titanium; Steel B, on the other hand, is microalloyed with titanium but was not superheated prior to teeming. Steel D has a higher base hardenability than Steels A–C, i.e. higher levels of carbon, manganese and chromium. Notice, however, that the level of the expensive molybdenum addition is lower than in Steels A–C, i.e. Steel D has a lower content of expensive alloying elements despite its higher base hardenability. In this case, micralloying with titanium combined with superheating to 1650° C. under two minutes prior to teeming results in a Jominy curve which is to all intents and purposes horizontal, i.e. the steel exhibits a very high level of hardenability indeed.

The mechanism whereby the hardenability level of the steel is increased via the special melting procedure incorporated in the present invention is not clear and is the subject of continuing study. It is perhaps significant that both aluminium and titanium, the addition of at least one of which appears necessary to secure the hardenability effect, are strong nitride formers. One possibility is, therefore, that increasing the temperature of a melt containing either titanium or aluminium (in excess of the amount required to kill the steel) or both causes titanium and/or aluminium nitrides to be dissolved, and reprecipitated once again during solidification of the steel after teeming. In this way, the dispersion of titanium or aluminium nitrides is finer than that which would have been produced had the melt not been superheated. The hypothesis is that this fine dispersion of titanium and/or aluminium nitrides retards the transformations to bainite and/or pearlite which normally limit the hardenability of the steel during cooling, and thereby a high level of hardenability is ensured.

Guided by the experiences from the laboratory experimentation described above, thirty tons of steel were produced in an electric-arc furnace. The melt was transferred to an ASEA-SKF ladle furnace and the following composition obtained (weight percent, except gases which are given in parts per million by weight).

TABLE 5

| C | Mn | Si | P | S | Cr | Mo | Ni | V | Al | Ti | N | O | H |
|---|---|---|---|---|---|---|---|---|---|---|---|---|---|
| 0.46 | 0.86 | 0.24 | 0.011 | 0.015 | 1.59 | 0.22 | 0.37 | 0.10 | 0.033 | 0.040 | 105 | 15 | 1.8 |

The melt was heated in the ladle furnace to a temperature of 1658° C. and held at this temperature for two minutes. The ladle was then transferred to a vacuum-degassing station and subjected to vacuum treatment combined with argon flushing for 20 minutes; after this treatment, the melt temperature was 1586° C.

The melt was subsequently allowed to cool further to 1565° C. before teeming. The final gas levels in the steel ingots are given in Table 5, below the alloy elements.

Figure 2:
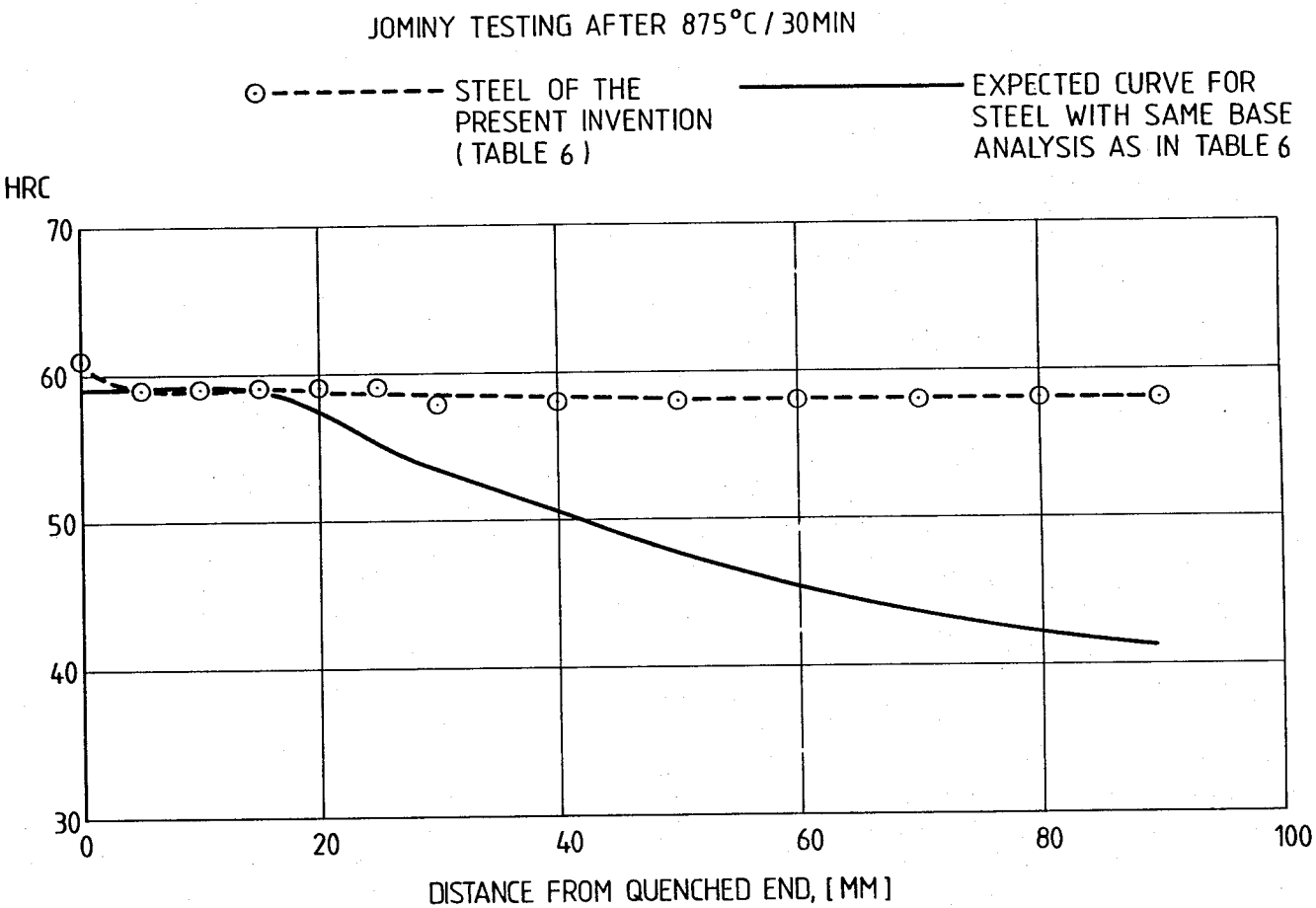
FIG. 2 shows the Jominy hardenability curve obtained for a full-scale melt (30 tons) of the steel of the invention.

The steel ingots were then forged to die blocks using conventional press-forging practice for manufacture of such blocks. Jominy specimens were taken from the forged material and tested, and the Jominy hardenability curve obtained is shown in FIG. 2. As can be seen the curve is more or less horizontal and well corresponds to that shown for Steel D in FIG. 1. Also included in FIG. 2 is a calculated Jominy curve, which is expected for a steel with the same analysis as that given in Table 5 but which has neither been microalloyed with titanium nor superheated prior to teeming. The pronounced effect on hardenability of the special treatment of the melt, which is advocated in the present invention, will be apparent.

A die-block made from the steel composition given in Table 5 was heat treated in the following way: Austenitizing 843° C./10 h, oil quenched to 121° C., temper 624° C./12 h. These heat treatment conditions for the die-block of the present invention are also given in FIG. 3.

The special advantages conferred by the present invention in the context of heavy-section forgings, and in particular for forging die blocks and associated parts, will become apparent from the comparison made in the following. The die block heat treated as indicated above and with a steel composition as given in Table 5 was compared with similar-sized blocks (300×500×500 mm) made from a steel with the following composition in weight percent.

TABLE 6

| C | Mn | Si | P | S | Cr | Mo | Ni | V |
|---|---|---|---|---|---|---|---|---|
| 0.55 | 0.76 | 0.31 | 0.009 | 0.023 | 0.95 | 0.40 | 1.06 | 0.05 |

Figure 3:
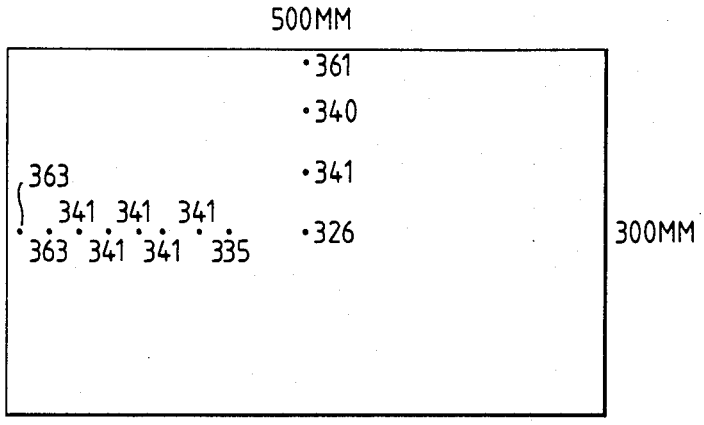
FIG. 3 presents data for the hardness distribution across forged and heat-treated die blocks for the steel of the invention, and a comparison, conventional die block steel.
Figure 3:
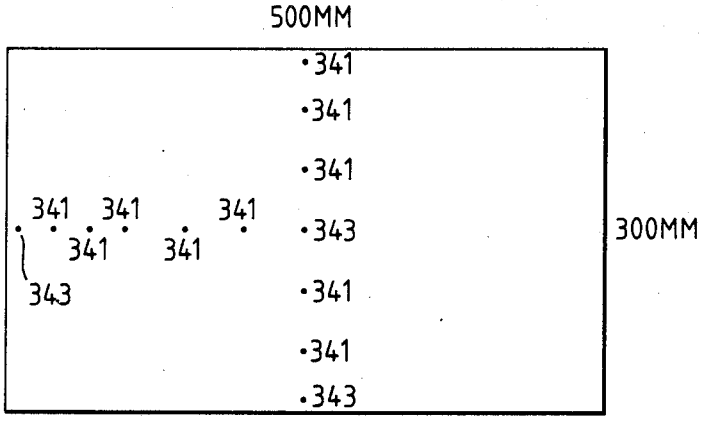

The hardness distribution in cross-sections through the centers of the two die blocks are given in FIG. 3. It is seen that the steel die block of the present invention exhibits a hardness uniformity which is at least as good as that characterizing the die block steel with composition given in Table 6.

I claim:

1. A low-alloy steel product in the form of a block, bar, plate, or forged shape made from a steel comprising, in weight percent:

| | |
|---|---|
| Carbon | 0.3 to 0.55 |
| Manganese | 0.3 to 1.5 |
| Silicon | from traces up to 1.0 |
| Chromium | 0.75 to 1.8 |
| Nickel | from traces up to 2.0 |

-continued

| | |
|---|---|
| Molybdenum | 0.05 to 0.4 |
| Vanadium | 0.05 to 0.15 |
| Phosphorus | 0.03 max |
| Sulphur | from traces up to 0.05 |
| Aluminum | 0.04 to 0.1 or |
| Titanium | 0.015 to 0.08, or |
| Aluminum and Titanium, | |

wherein the total amount of Al+2×Ti is about 0.04 to about 0.16, balance iron, the bulk of the steel having been melted in a furnace said aluminum and/or titanium having been added to the steel melt by microalloying after melting the bulk of the steel, the microalloyed steel having been subjected to superheating to at least 1625° C. for at least two minutes prior to teeming, casting to ingots, and hot working the ingots to form said block, bar, plate or forged shape, said steel having a Jominy hardenability corresponding to a hardness of more than 50 HRC at a distance of 50 mm from the quenched end after austenitization at 875° C. for 30 minutes.

2. A low-alloy steel product according to claim 1, wherein the steel comprises, in weight percent:

| | |
|---|---|
| Carbon | 0.4 to 0.55 |
| Manganese | 0.5 to 1.2 |
| Silicon | from traces up to 1.0 |
| Chromium | 1.1 to 1.8 |
| Nickel | 0.2 to 1.2 |
| Molybdenum | 0.15 to 0.4 |
| Vanadium | 0.05 to 0.15 |
| Phosphorus | 0.025 max |
| Sulphur | 0.005 to 0.05 |
| Aluminum | 0.04 to 0.08 or |
| Titanium | 0.015 to 0.06 or |
| Aluminum and Titanium, wherein | |

the total amount of Al+2×Ti is about 0.04 to about 0.13, balance iron.

3. A low-alloy steel product according to claim 2, wherein the steel comprises, in weight percent:

| | |
|---|---|
| Carbon | 0.42 to 0.49 |
| Manganese | 0.6 to 1.0 |
| Silicon | up to 0.4 |
| Chromium | 1.4 to 1.7 |
| Nickel | 0.2 to 0.8 |
| Molybdenum | 0.15 to 0.30 |
| Vanadium | 0.07 to 0.13 |
| Phosphorus | 0.025 max |
| Sulphur | 0.025 to 0.045 |
| Aluminum | 0.04 to 0.07 or |
| Titanium | 0.015 to 0.06 or |
| Aluminum and Titanium, wherein | |

the total amount of Al+2×Ti is about 0.04 to about 0.12, balance iron.

4. A low-alloy steel product according to claim 1, 2 or 3, wherein the steel product has been austenitized at a temperature of between 800° and 900° C., quenched in oil, and tempered at between 500° and 700° C.

5. A low-alloy steel product according to claim 4, wherein the product consists of a die block or other forged shape.

* * * * *